US010618689B1

(12) United States Patent
Anderson et al.

(10) Patent No.: US 10,618,689 B1
(45) Date of Patent: Apr. 14, 2020

(54) TOP CAP GUARD

(71) Applicant: International Business Machines Corporation, Armonk, NY (US)

(72) Inventors: Ryan Anderson, Rochester, MN (US); Benjamin Luedeman, Rochester, MN (US); Justin Melby, Rochester, MN (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 16/146,292

(22) Filed: Sep. 28, 2018

(51) Int. Cl.
*B65D 19/38* (2006.01)
*B65D 5/44* (2006.01)
*B65D 5/12* (2006.01)

(52) U.S. Cl.
CPC ..... *B65D 19/385* (2013.01); *B65D 5/12* (2013.01); *B65D 5/445* (2013.01)

(58) Field of Classification Search
CPC ..... B65D 19/385; B65D 5/12; B65D 5/445
USPC ..... 108/51.3, 55.1
See application file for complete search history.

(56) References Cited

U.S. PATENT DOCUMENTS 1,663,102 A 3/1928 Dallas
1,679,891 A 8/1928 Bees
2,050,791 A 8/1936 Graham
2,316,854 A * 4/1943 George ..... B65D 5/446 217/12 R
2,488,692 A * 11/1949 Talbot ..... B65D 9/18 217/12 R
2,596,320 A * 5/1952 Witte ..... B65D 9/12 217/12 R (Continued)

FOREIGN PATENT DOCUMENTS

GB 405086 A 2/1934
JP H10147326 A 6/1998
JP 2009249003 A 10/2009

OTHER PUBLICATIONS

Anonymous, "Rack Relocation Services", Online Downloaded Sep. 28, 2018, URL:<https://www.mccollisters.com/technical-services/rack-relocation>, 10 pages.

(Continued)

*Primary Examiner* — Jose V Chen
(74) *Attorney, Agent, or Firm* — Cantor Colburn LLP; Tihon Poltavets

(57) ABSTRACT

A top cap guard is provided. The top cap guard includes a sheet having opposed first edges and opposed second edges and defining first and second apertures along each of the first edges and each of the second edges, respectively, and first and second rigid members respectively disposable along one of the first and second edges, respectively. The top cap guard further includes first and second flaps. The first flaps are respectively attached to one of the first edges. Each first flap is configured to wrap around the corresponding first rigid member and includes first tongues respectively securable in corresponding ones of the first apertures. The second flaps are respectively attached to one of the second edges. Each second flap is configured to wrap around the corresponding second rigid member and includes second tongues respectively securable in corresponding ones of the second apertures.

18 Claims, 4 Drawing Sheets

(56) References Cited

U.S. PATENT DOCUMENTS 2,812,096 A * 11/1957 Muller ..... B65D 19/02 217/65
2,965,276 A * 12/1960 Foster ..... B65D 19/14 206/599
3,029,994 A 4/1962 Chapman
3,136,472 A * 6/1964 Waller ..... B65D 9/12 229/199.1
3,616,986 A * 11/1971 Wolfe ..... B65D 85/64 206/320
3,968,895 A * 7/1976 Barnes, Jr. ..... B65D 7/24 220/1.5
3,986,659 A * 10/1976 Vajtay ..... B65D 15/08 229/125.17
4,013,168 A * 3/1977 Bamburg ..... B65D 5/2033 206/386
4,171,741 A * 10/1979 Fish ..... B65D 85/68 206/335
4,765,252 A * 8/1988 Shuert ..... B65D 15/22 108/55.1
4,936,451 A * 6/1990 Shuert ..... B65D 15/22 108/55.1
5,029,734 A * 7/1991 Nichols ..... B65D 19/06 108/55.3
5,109,985 A * 5/1992 Rose ..... B65D 19/06 108/55.1
5,279,423 A * 1/1994 Shuert ..... B65D 5/4266 206/524.2
RE34,557 E * 3/1994 Grigsby ..... B65D 5/446 206/335
5,622,306 A * 4/1997 Grigsby, Sr. ..... B65D 5/446 206/386
6,019,226 A * 2/2000 Zajdlik ..... B65D 19/16 108/55.1
6,050,410 A * 4/2000 Quirion ..... B65D 19/20 206/386
6,227,366 B1 * 5/2001 Eckard ..... B65D 71/04 206/386
6,244,443 B1 * 6/2001 Nickell ..... B65D 19/06 206/600
7,513,365 B2 * 4/2009 Cornelius ..... B65D 19/20 108/56.1
7,699,180 B2 4/2010 Mollard et al.
8,783,461 B2 * 7/2014 Hill ..... B65D 19/20 108/51.3
2016/0107793 A1 4/2016 Jiang et al.

OTHER PUBLICATIONS

Anonymous, "RTST_Rack_Handling_Guide", Rack Transport Stability Team (RTST); Version 3: Updated Apr. 2012, 62 pages.

* cited by examiner

TOP CAP GUARD

BACKGROUND

The present invention generally relates rack protection, and more specifically, to a top cap guard for protecting top edges of a rack during shipment.

In certain situations, large computing devices are packaged and shipped. The modes of shipment can include local movements as well as ground, air and sea transportations that require that the packages be manipulated. For example, during shipment and delivery, a given package can be placed on a pallet at various times to aid in local movements. In such cases, the pallet or the package can be tipped over due to the top-heaviness of the package or bumped into obstacles, such as door entrances. The impacts associated with these types of events can cause the large computing devices to impact the package and can lead to damage or even failure of the large computing devices and loss of revenue.

SUMMARY

Embodiments of the present invention are directed to a top cap guard A non-limiting example of the top cap guard includes a sheet having opposed first edges and opposed second edges and defining first and second apertures along each of the first edges and each of the second edges, respectively, and first and second rigid members respectively disposable along one of the first and second edges, respectively. The non-limiting example of the top cap guard further includes first and second flaps. The first flaps are respectively attached to one of the first edges. Each first flap is configured to wrap around the corresponding first rigid member and includes first tongues respectively securable in corresponding ones of the first apertures. The second flaps are respectively attached to one of the second edges. Each second flap is configured to wrap around the corresponding second rigid member and includes second tongues respectively securable in corresponding ones of the second apertures.

Embodiments of the present invention are directed to a shipping assembly. A non-limiting example of the shipping assembly is provided and includes a pallet, a package configured to encompass an item to be shipped, which is disposable on the pallet and a top cap guard. The top cap guard is configured to fit onto an upper portion of the package. The top cap guard includes rigid members respectively disposable along edges of the upper portion of the package and a sheet. The sheet is configured to secure the rigid members in place.

Embodiments of the invention are directed to a shipping assembly. A non-limiting example of the shipping assembly includes a pallet, a package configured to encompass an item to be shipped, which is disposable on the pallet and a top cap guard. The top cap guard is configured to fit onto an upper portion of the package. The top cap guard includes rigid members respectively disposable along edges of the upper portion of the package and a sheet. The sheet is configured to form an enclosure about the upper portion of the package and to secure the rigid members in place within the enclosure.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE DRAWINGS

The specifics of the exclusive rights described herein are particularly pointed out and distinctly claimed in the claims at the conclusion of the specification. The foregoing and other features and advantages of the embodiments of the invention are apparent from the following detailed description taken in conjunction with the accompanying drawings in which:

Figure 1:
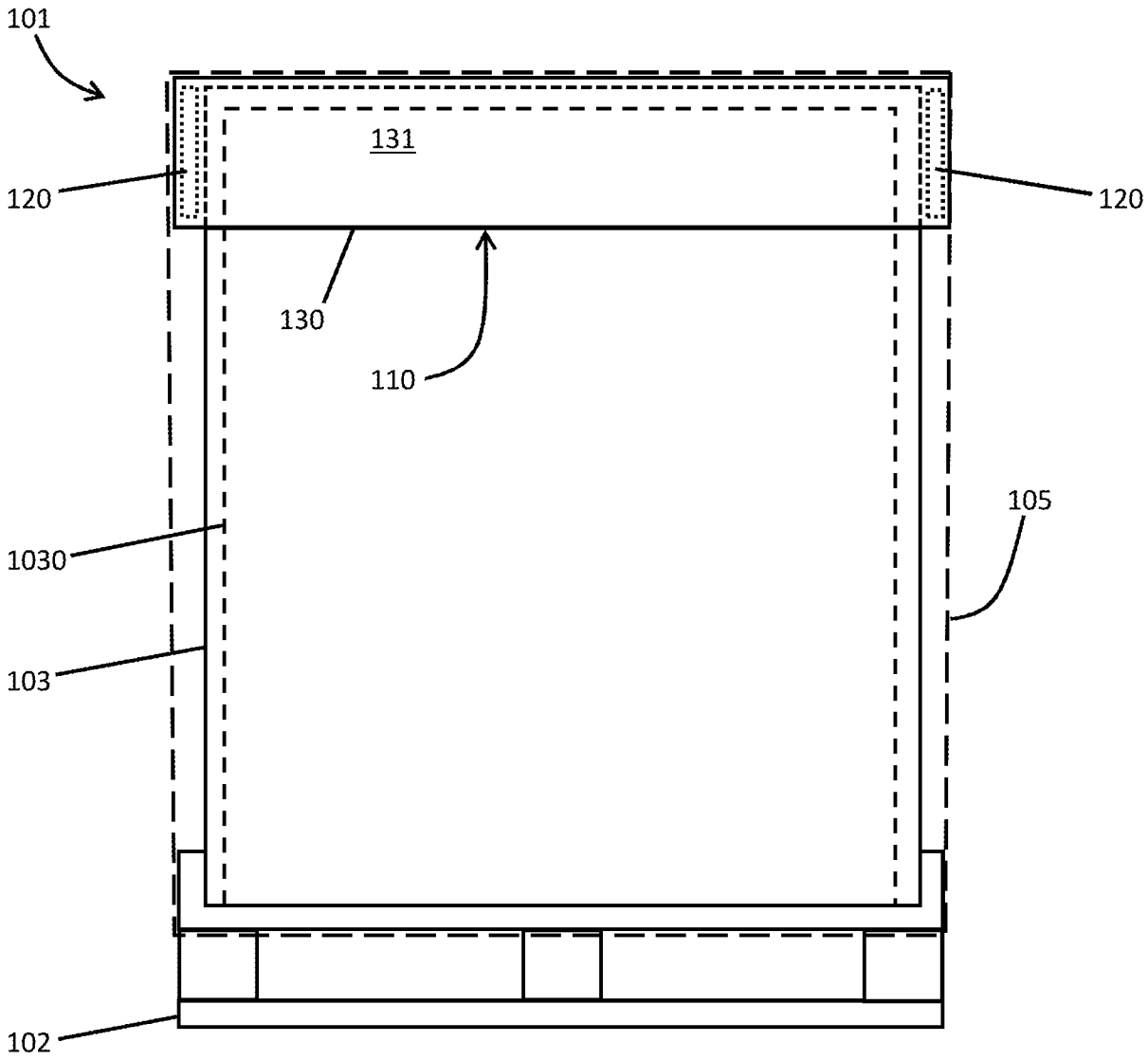
FIG. 1 is a cross-sectional view of a shipping assembly in accordance with embodiments of the present invention.

The diagrams depicted herein are illustrative. There can be many variations to the diagram or the operations described therein without departing from the spirit of the invention. For instance, the actions can be performed in a differing order or actions can be added, deleted or modified. Also, the term "coupled" and variations thereof describes having a communications path between two elements and does not imply a direct connection between the elements with no intervening elements/connections between them. All of these variations are considered a part of the specification.

In the accompanying figures and following detailed description of the disclosed embodiments, the various elements illustrated in the figures are provided with two or three digit reference numbers. With minor exceptions, the leftmost digit(s) of each reference number correspond to the figure in which its element is first illustrated.

DETAILED DESCRIPTION

Various embodiments of the invention are described herein with reference to the related drawings. Alternative embodiments of the invention can be devised without departing from the scope of this invention. Various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. Moreover, the various tasks and process steps described herein can be incorporated into a more comprehensive procedure or process having additional steps or functionality not described in detail herein.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" may be understood to include any integer number greater than or equal to one, i.e. one, two, three, four, etc. The terms "a plurality" may be understood to include any integer number greater than or equal to two, i.e. two, three, four, five, etc. The term "connection" may include both an indirect "connection" and a direct "connection."

The terms "about," "substantially," "approximately," and variations thereof, are intended to include the degree of error associated with measurement of the particular quantity based upon the equipment available at the time of filing the application. For example, "about" can include a range of ±8% or 5%, or 2% of a given value.

For the sake of brevity, conventional techniques related to making and using aspects of the invention may or may not be described in detail herein. In particular, various aspects of computing systems and specific computer programs to implement the various technical features described herein are well known. Accordingly, in the interest of brevity, many conventional implementation details are only mentioned briefly herein or are omitted entirely without providing the well-known system and/or process details.

Turning now to an overview of technologies that are more specifically relevant to aspects of the invention, when large computing devices are packaged and shipped and the modes of shipment can include local movements as well as ground, air and sea transportations that require that the packages be manipulated it is often necessary to provide for structures that aid in shipment and manipulation. These structures do not always offer suitable protection for the item being shipped. That is, in the exemplary case where a large computing device being shipped is placed on a pallet and the pallet or the large computing device tips over due to its top-heaviness or is bumped into obstacles, such as door entrances, the impacts associated with these types of events can cause the large computing device to impact its packaging. This can lead to damage or even failure of the large computing device and a loss of revenue.

Turning now to an overview of the aspects of the invention, one or more embodiments of the invention address the above-described shortcomings of the prior art by providing for a shipping assembly that includes a pallet, a package configured to encompass an item to be shipped, which is disposable on the pallet and a top cap guard. The top cap guard is configured to fit onto an upper portion of the package and includes rigid members respectively disposable along edges of the upper portion of the package and a sheet, which is configured to secure the rigid members in place.

The above-described aspects of the invention address the shortcomings of the prior art by usage of at least two different types of materials to provide a maximum amount of protection to the top of a package, such as a rack, which in some cases is the most susceptible part to damage. The materials are formed into a reinforced top guard that can be placed over existing packaging. The rigid materials create a framework that acts as a load spreader and distributes major impacts that would otherwise permeate current packaging and cause damages. The other materials hold the rigid materials in place.

Turning now to a more detailed description of aspects of the present invention, FIG. 1 depicts a shipping assembly 101. The shipping assembly 101 includes a pallet 102, a package 103, which is disposable on the pallet 102 and which is configured to encompass an item to be shipped 1030, such as a top-heavy rack for computing devices, and a top cap guard 110. The top cap guard 110 is configured to tightly fit onto an upper portion of the package 103. The top cap guard 110 includes rigid members 120 and a sheet 130. The rigid members 120 can be formed of various rigid or semi-rigid materials, such as wood or metallic materials, and are respectively disposable along edges of the upper portion of the package 103. The sheet 130 can be formed of corrugated cardboard and is configured to form an enclosure 131 about the upper portion of the package 103 and to secure the rigid members 120 in place within the enclosure 131.

Figure 2:
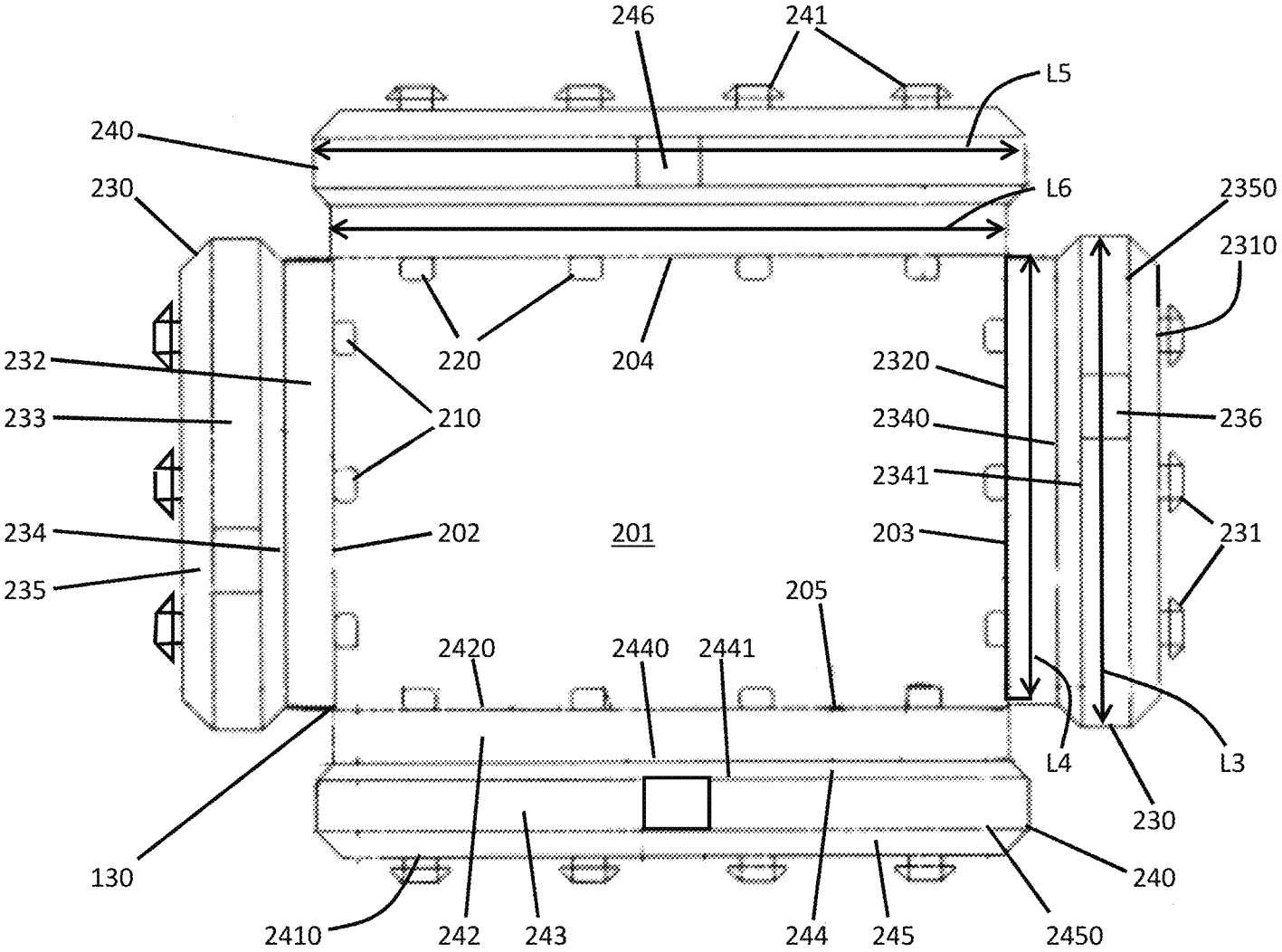
FIG. 2 is a die-cut view of a sheet of a top cap guard of the shipping assembly of FIG. 1 in accordance with embodiments of the present invention.

With reference to FIG. 2, the sheet 130 of the top cap guard 110 has a generally planar and rectangular shape with a central section 201 that is delimited by opposed first edges 202 and 203 and opposed second edges 204 and 205 and is formed to define first apertures 210 along each of the first edges 202 and 203 and second apertures 220 along each of the second edges 204 and 205. The rigid members 120 can include a pair of first rigid members 121 that are respectively disposable along a corresponding one of the first edges 202 and 203 and a pair of second rigid members 122 that are respectively disposable along a corresponding one of the second edges 204 and 205 (see FIG. 3). The sheet 130 further includes a pair of first flaps 230 and a pair of second flaps 240. Each of the first flaps 230 are respectively attached to a corresponding one of the first edges 202 and 203. Each first flap 230 is configured to wrap around the corresponding first rigid member 121 and includes first tongues 231 that are respectively securable in corresponding ones of the first apertures 210. Each of the second flaps 240 are respectively attached to a corresponding one of the second edges 204 and 205. Each second flap 240 is configured to wrap around the corresponding second rigid member 122 and includes second tongues 241 that are respectively securable in corresponding ones of the second apertures 220.

Figure 3:
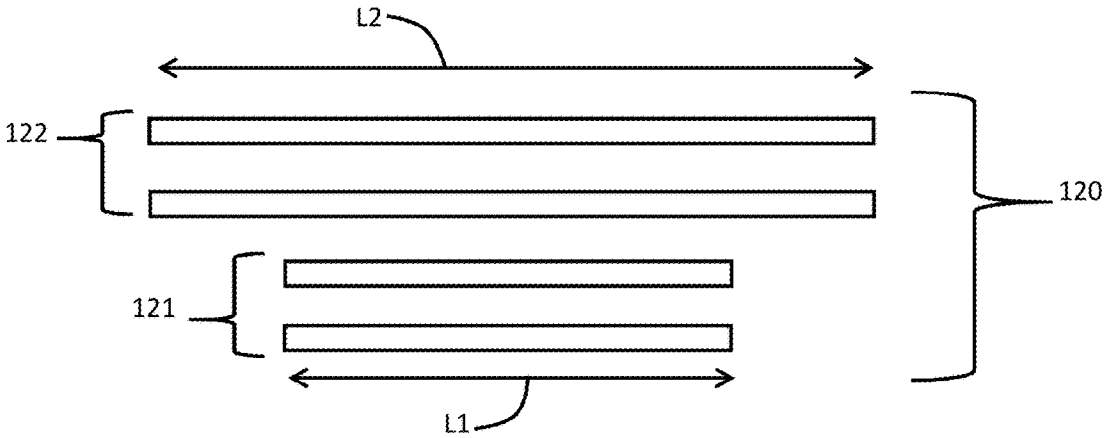
FIG. 3 is a top-down view of rigid members of a top cap guard of the shipping assembly of FIG. 1 in accordance with embodiments of the present invention.

With reference to FIG. 3 and in accordance with embodiments of the present invention, a length L1 of the first rigid members 121 can be equal to or less than a corresponding length of the first edges 202 and 203 whereas a length L2 of the second rigid members 122 can be equal to or less than a corresponding length of the second edges 204 and 205 plus a width of each of the first rigid members 121.

Figure 4:
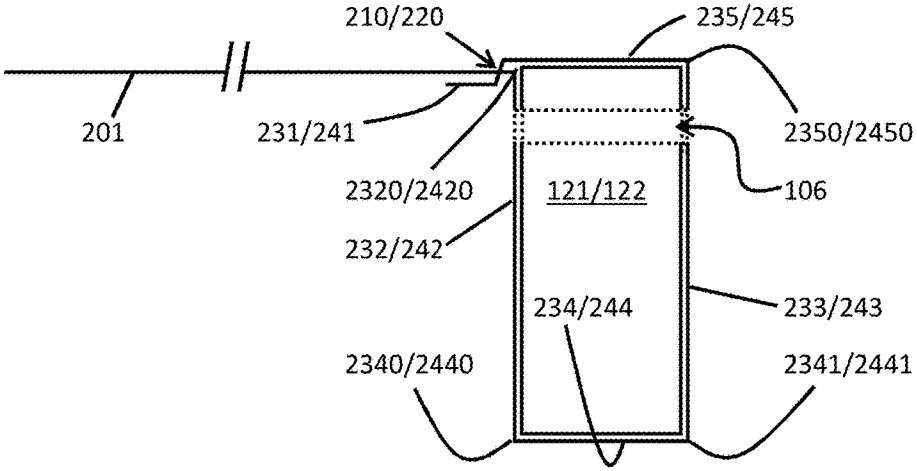
FIG. 4 is an enlarged side view of a portion of the sheet of the top cap guard and a rigid member of the top cap guard of FIGS. 2 and 3.

With reference back to FIG. 2 and with additional reference to FIG. 4, each of the first flaps 230 includes a proximal flap section 232, a distal flap section 233 that has a length L3 that is longer than a length L4 of the proximal flap section 232, an inboard tapered section 234 and an outboard tapered section 235 and each of the second flaps 240 includes a proximal flap section 242, a distal flap section 243 that has a length L5 that is longer than a length L6 of the proximal flap section 242, an inboard tapered section 244 and an outboard tapered section 245.

For the first flaps 230, the proximal flap section 232 is attached to one of the first edges 202 and 203 along a first fold 2320. The inboard tapered section 234 is attached to a distal edge of the proximal flap section 232 along a second fold 2340 and to a proximal edge of the distal flap section 233 along a third fold 2341 and thus extends between the distal edge of the proximal flap section 232 and the proximal edge of the distal flap section 233. The inboard tapered section 234 has a taper at both of its ends and increases in length with increasing distance from the proximal flap section 232. The outboard tapered section 235 is attached to a distal edge of the distal flap section 233 along a fourth fold 2350, extends from the distal edge of the distal flap section 233 and decreases in length with increasing distance from the distal flap section 233. The first tongues 231 are attached to a distal edge of the outboard tapered section 235 along fifth folds 2310.

For the second flaps 240, the proximal flap section 242 is attached to one of the second edges 204 and 205 along a first fold 2420. The inboard tapered section 244 is attached to a distal edge of the proximal flap section 242 along a second fold 2440 and to a proximal edge of the distal flap section 243 along a third fold 2441 and thus extends between the distal edge of the proximal flap section 242 and the proximal edge of the distal flap section 243. The inboard tapered section 244 has a taper at both of its ends and increases in length with increasing distance from the proximal flap section 242. The outboard tapered section 245 is attached to a distal edge of the distal flap section 243 along a fourth fold 2450, extends from the distal edge of the distal flap section 243 and decreases in length with increasing distance from the distal flap section 243. The second tongues 241 are attached to a distal edge of the outboard tapered section 235 along fifth folds 2410.

In accordance with embodiments of the present invention and as shown in FIG. 2, each of the first flaps 230 can include a window 236 and each of the second flaps 240 can include a window 246.

With reference to FIG. 4, an assembly of the first and second flaps 230 and 240 is illustrated. As shown in FIG. 4, the proximal flap section 232/242 is folded +90° relative to the central section 201 along first fold 2320/2420, the inboard tapered section 234/244 is folded −90° relative to the proximal flap section 232/242 along second fold 2340/2440, the distal flap section 233/243 is folded −90° relative to the inboard tapered section 234/244 along third fold 2341 and 2441 and the outboard tapered section 235/245 is folded −90° relative to the distal flap section 233/243 along fourth fold 2350/2450. The proximal flap section 232/242, the inboard tapered section 234/244, the distal flap section 233/243 and the outboard tapered section 235/245 thus form an interior space in which the first or second rigid members 121 or 122 are insertable. The first and second tongues 231 and 241 are folded relative to the outboard tapered section 235/245 along fifth folds 2350/2450 and fit into the first and second apertures 210 and 220 to secure the first and second flaps 230 and 240.

Figure 5:
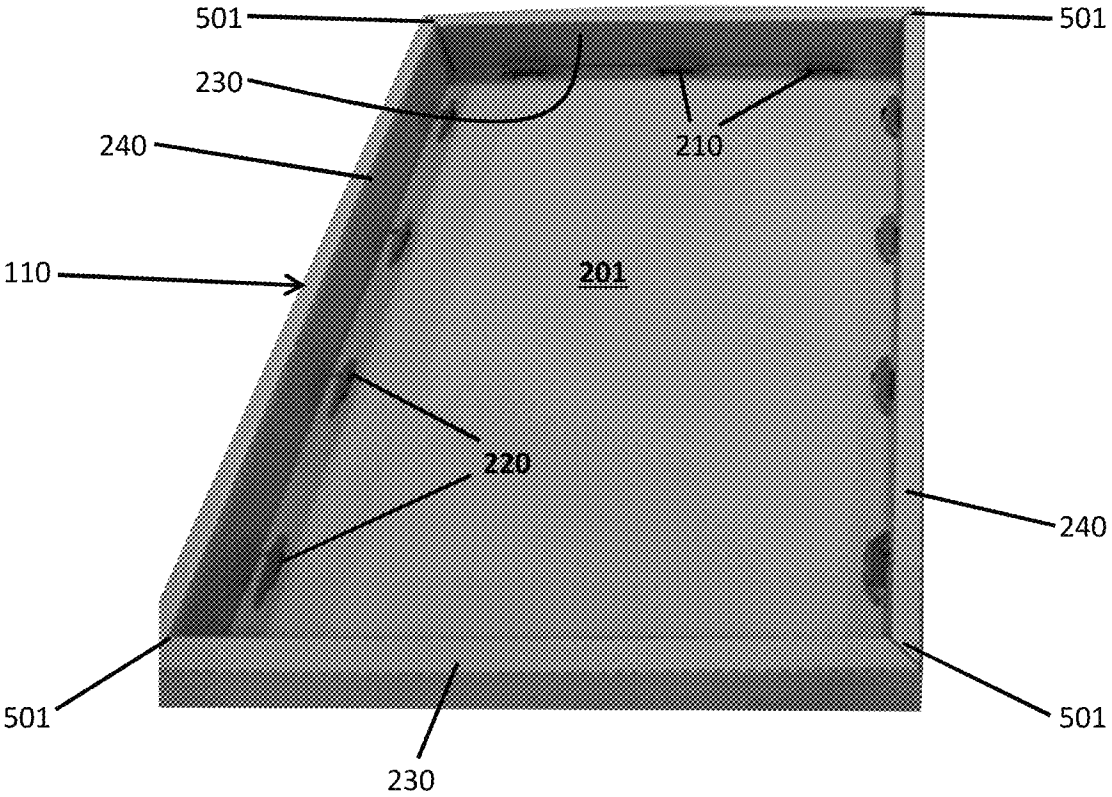
FIG. 5 is a perspective view of an assembly of a top cap guard of a shipping assembly in accordance with embodiments of the present invention.

With reference to FIG. 5, the tapering of the inboard tapered sections 234/244 and the tapering of the outboard tapered sections 235/245 form corners 501 and provide for ample spacing for the first flaps 230 and the second flaps 240 once the above-noted folds are made.

In accordance with additional embodiments of the present invention and with reference back to FIG. 1, the top cap guard 110 can be tightly and securely fit onto the upper portion of the package 103. However, in some cases, the top cap guard 110 can further include a securing element 105 to further secure the top cap guard 110 to at least one of the package 103 and the pallet 102. The securing element 105 can include or be provided, for example, as a cord or a strap that can be fit about the top cap guard 110 and the package 103 or about the top cap guard 110 and the pallet 102. This cord or strap can be fit about an entirety of the top cap guard 110 or can be threaded through corresponding openings 106 (see FIG. 4) in the top cap guard 110.

The present invention may be a system at any possible technical detail level of integration.

Aspects of the present invention are described herein with reference to flowchart illustrations and/or block diagrams of methods and apparatuses (systems). It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments described herein.

What is claimed is:

1. A top cap guard, comprising:

a sheet having opposed first edges and opposed second edges and defining first and second apertures along each of the first edges and each of the second edges, respectively;

first and second rigid members respectively disposable along one of the first and second edges, respectively;

first flaps respectively attached to one of the first edges, each first flap being configured to wrap around the corresponding first rigid member and comprising first tongues respectively securable in corresponding ones of the first apertures; and second flaps respectively attached to one of the second edges, each second flap being configured to wrap around the corresponding second rigid member and comprising second tongues respectively securable in corresponding ones of the second apertures.

2. The top cap guard according to claim 1, wherein the sheet comprises corrugated cardboard.

3. The top cap guard according to claim 1, wherein the first and second rigid members comprise wood.

4. The top cap guard according to claim 1, wherein:

a length of the first rigid members is equal to or less than a length of the first edges, and a length of the second rigid members is equal to or less than a length of the second edges plus a width of each of the first rigid members.

5. The top cap guard according to claim 1, wherein the first and second flaps each comprise:

a proximal flap section attached to the one of the first or the second edges along a first fold;

a distal flap section, which is longer than the proximal flap section;

an inboard tapered section extending between distal and proximal edges of the proximal and distal flap sections; and an outboard tapered section extending from a distal edge of the distal flap section and to which the first or the second tongues are attached.

6. The top cap guard according to claim 1, wherein the first and second flaps are each formed to define an aperture.

7. A shipping assembly, comprising:

a pallet;

a package configured to encompass an item to be shipped, which is disposable on the pallet; and a top cap guard configured to fit onto an upper portion of the package, the top cap guard comprising rigid members respectively disposable along edges of the upper portion of the package and a sheet, which is configured to secure the rigid members in place, wherein:

the sheet of the top cap guard has opposed first edges and opposed second edges and defines first and second apertures along each of the first edges and each of the second edges, respectively, the rigid members comprise first and second rigid members respectively disposable along one of the first and second edges, respectively, and the sheet comprises:

first flaps respectively attached to one of the first edges, each first flap being configured to wrap around the corresponding first rigid member and comprising first tongues respectively securable in corresponding ones of the first apertures; and second flaps respectively attached to one of the second edges, each second flap being configured to wrap around the corresponding second rigid member and comprising second tongues respectively securable in corresponding ones of the second apertures, wherein the first and second flaps each comprise a proximal flap section attached to the one of the first or the second edges, a distal flap section, which is longer than the proximal flap section, an inboard tapered section extending between distal and proximal edges of the proximal and distal flap sections and an outboard tapered section extending from a distal edge of the distal flap section and to which the first or the second tongues are attached.

8. The shipping assembly according to claim 7, wherein the item to be shipped is top-heavy.

9. The shipping assembly according to claim 7, wherein the sheet comprises corrugated cardboard and the rigid members comprise wood.

10. The shipping assembly according to claim 7, wherein the top cap guard tightly fits onto the upper portion of the package.

11. The shipping assembly according to claim 7, further comprising a securing element to secure the top cap guard to at least one of the package and the pallet.

12. The shipping assembly according to 7, wherein:

a length of the first rigid members is equal to or less than a length of the first edges, and a length of the second rigid members is equal to or less than a length of the second edges plus a width of each of the first rigid members.

13. The shipping assembly according to claim 7, wherein the first and second flaps are each formed to define an aperture.

14. A shipping assembly, comprising:

a pallet;

a package configured to encompass an item to be shipped, which is disposable on the pallet; and a top cap guard configured to fit onto an upper portion of the package, the top cap guard comprising rigid members respectively disposable along edges of the upper portion of the package and a sheet, which is configured to form an enclosure about the upper portion of the package and to secure the rigid members in place within the enclosure, wherein:

the sheet of the top cap guard has opposed first edges and opposed second edges and defines first and second apertures along each of the first edges and each of the second edges, respectively, the rigid members comprise first and second rigid members respectively disposable along one of the first and second edges, respectively, and the sheet comprises:

first flaps respectively attached to one of the first edges, each first flap being configured to wrap around the corresponding first rigid member and comprising first tongues respectively securable in corresponding ones of the first apertures; and second flaps respectively attached to one of the second edges, each second flap being configured to wrap around the corresponding second rigid member and comprising second tongues respectively securable in corresponding ones of the second apertures, wherein the first and second flaps each comprise a proximal flap section attached to the one of the first or the second edges, a distal flap section, which is longer than the proximal flap section, an inboard tapered section extending between distal and proximal edges of the proximal and distal flap sections and an outboard tapered section extending from a distal edge of the distal flap section and to which the first or the second tongues are attached.

15. The shipping assembly according to claim 14, wherein the item to be shipped is top-heavy.

16. The shipping assembly according to claim 14, wherein the sheet comprises corrugated cardboard and the rigid members comprise wood.

17. The shipping assembly according to claim 14, wherein the top cap guard tightly fits onto the upper portion of the package.

18. The shipping assembly according to claim 14, further comprising a securing element to secure the top cap guard to at least one of the package and the pallet.

* * * * *